United States Patent [19]

LaPointe

[11] Patent Number: 4,836,249

[45] Date of Patent: Jun. 6, 1989

[54] ROTARY-ACTION DIRECTIONAL CONTROL VALVE

[75] Inventor: Ronald R. LaPointe, Taylors, S.C.

[73] Assignee: Webster Electric Co.,Inc., Racine, Wis.

[21] Appl. No.: 162,561

[22] Filed: Mar. 1, 1988

[51] Int. Cl.[4] ..... F15B 13/04

[52] U.S. Cl. ..... 137/625.23; 137/625.24; 137/596.2

[58] Field of Search ..... 137/625.21, 625.22, 137/625.23, 625.24, 596.2

[56] References Cited

U.S. PATENT DOCUMENTS 3,443,586 5/1969 Christensen ..... 137/625.24 X 3,973,379 8/1976 Ecker et al. ..... 56/11.9

4,109,682 8/1978 Grudjonsson ..... 137/625.24

*Primary Examiner*—Alan Cohan

*Attorney, Agent, or Firm*—Peter N. Ltd. Jansson

[57] ABSTRACT

An improved rotary-action directional flow control valve for hydraulic hydraulic motors and the like. The valve provides pressure-compensating constant flow in one or both directions. The valve has a main spool rotatable within a valve body to plural positions to determine flow direction, and one or more inner spools or the like in cavities within the main spool to provide the pressure-compensating. A plurality of spool voids and orifices form, with the valve body, flow channels between ports in the valve body.

25 Claims, 5 Drawing Sheets

ROTARY-ACTION DIRECTIONAL CONTROL VALVE

FIELD OF THE INVENTION

This invention is related generally to hydraulic control valves and, more particularly, to directional control valves for hydraulic motors.

BACKGROUND OF THE INVENTION

Innovation in the field of hydraulic controls has continued over the course of many decades as improvements in hydraulic valve configurations have been made to meet particular needs. The prior art includes a variety of rotary-action and/or directional control valves for hydraulic motors of various kinds and serving various purposes.

Some examples of prior hydraulic control valves are those disclosed in the following U.S. patents:

U.S. Pat. No. 3,796,232 (Dalton)
U.S. Pat. No. 4,445,540 (Baron et al.)
U.S. Pat. No. 3,506,706 (Schmitz)
U.S. Pat. No. 3,405,602 (Clarke)
U.S. Pat. No. 4,372,341 (Crawley)
U.S. Pat. No. 2,519,574 (Holl)
U.S. Pat. No. 4,564,045 (Koch et al.)
U.S. Pat. No. 3,083,731 (Hasbany)
U.S. Pat. No. 2,471,285 (Rice)
U.S. Pat. No. 2,622,372 (Moulden).

For a variety of hydraulic applications, flow in both directions through the motor is required. In any situation in which a driven member is moved (typically rotated) in one direction at certain times and in the other direction at other times, a directional hydraulic control valve is needed One example is a hydraulic motor of the type that drives the cutting reels of commercial lawn mowing equipment, which requires hydraulic flow in one direction to turn the reels in a cutting direction and in the reverse direction to sharpen the blades.

In this specific application and many others, it is often highly desirable not only to have a hydraulic control device which reverses the flow but one providing a preset constant drive rate in at least one direction. In some cases, constant drive rates in both directions (although perhaps differing from each other) are highly desirable. Constant drive rates require a substantially constant flow of hydraulic fluid into the hydraulic motor, regardless of changing input pressures and loads.

In the example of the hydraulic motor for driving mowing reels, it is at least desirable to provide a constant and fairly low rate of hydraulic drive (flow) in the reverse (blade-sharpening) direction. A constant flow rate may be less important for the hydraulic drive in the forward direction; in this particular application, it may in some cases be acceptable to allow the forward flow rate to vary widely, depending on input pressure and load, while in other cases it may be desirable to have a constant forward flow as well as a constant reverse flow. In either case, a significantly greater flow is typically desirable in the forward direction.

Hydraulic devices which carry out a number of functions, such as those described above, are typically quite complex and in some cases bulky in construction. There is a need for an improved hydraulic directional control valve which includes pressure-compensating features to provide constant flow in one or both output directions. An improved hydraulic control valve is needed which has these multi-function capabilities, yet is compact, simple in construction and easy to manufacture and assemble.

OBJECTS OF THE INVENTION

It is an object of this invention to provide an improved hydraulic directional control valve overcoming some problems and shortcomings of prior control valves.

Another object of this invention is to provide an improved rotary-action directional control valve with pressure-compensating devices for constant flow in one or in both directions.

Another object of this invention is to provide a directional control valve with pressure-compensation and multi-function control without adding size.

Another object of this invention is to provide an improved multi-function rotary-action directional control valve which is compact and simple in construction.

These and other important objects will be apparent from the descriptions of this invention which follow.

SUMMARY OF THE INVENTION

This invention is an improved rotary-action directional flow control valve for use with hydraulic apparatus such as reversible hydraulic motors. The control valve of this invention has forward and reverse output ports and is mountable on a hydraulic motor with its forward and reverse output ports in alignment with forward and reverse input ports of the motor.

The principal parts of the valve are a valve body, a main spool in the valve body, and means within such spool responsive to inlet and load pressures to maintain substantially constant outflow through at least one of two output ports in the valve body.

For convenience in describing this invention, the constant outflow will be said to be through a "reverse" port. However, "forward" and "reverse" are used herein primarily to designate opposites. Such terms are not intended necessarily to match descriptions or common understandings of particular hydraulic motors or control valves. Thus, "forward" can be taken to mean "reverse" if "reverse" is at the same time taken to mean "forward."

In certain highly preferred embodiments, the main spool has second means within the main spool responsive to inlet and load pressures to maintain substantially constant outflow through the other valve body output port.

The valve body has a cylindrical wall which forms a cylindrical main cavity containing the main spool. The cylindrical main cavity defines an axis which serves as a reference line for descriptions of the valve and of its elements. The control valve has first and second ends along such axis, with the valve body and main spool each having corresponding first and second ends.

As indicated, the valve body has axially-spaced forward and reverse ports defined by the cylindrical wall, preferably along one side of the wall. Such forward and reverse ports may be along a line parallel to the axis of the cylinder.

Between the forward and reverse ports, in preferred embodiments, the cylindrical wall has a middle portion defining pressure and tank ports. The pressure and tank ports are in rotationally offset positions, preferably spaced by 180 degrees and at a common axial position with respect to the axis of the cylindrical wall. The pressure and tank ports are aligned with one another along a line transverse to the axis of the main cavity. The pressure and tank ports are on opposite sides of such main cavity.

Hydraulic fluid is received from the pressure port and directed as desired through the forward or reverse port to drive the motor in the forward or reverse directions. Fluid exiting through the forward port returns to the valve from the motor through the reverse port. Likewise, fluid exiting through the reverse port returns to the control valve from the motor through the forward port. The rotational position of the main spool in the valve body determines the direction and mode of flow.

The main spool is a cylindrical body rotatable in the main cylindrical cavity. The cylindrical dimensioning of the valve body wall and the main spool is such that there is good surface-to-surface engagement, as is well known for rotary valves. The main spool is rotatable to forward, reverse and neutral positions, including at least one forward position. In preferred embodiments, a control handle for rotating the main spool is secured to the main spool at the first end thereof.

The main spool has a mid-section which is adjacent to the middle portion of the cylindrical wall of the valve body. The terms "mid-section" and "middle portion" are used herein to facilitate description and understanding of the valve structure. The first and second ends of the main spool, mentioned above, are beyond the reverse and forward ports, respectively.

The main spool has an inner wall, itself preferably cylindrical, which forms an inner cavity extending axially from the mid-section to the first end of the main spool. Within the inner cavity is means responsive to inlet and load pressures to maintain substantially constant flow through the reverse port when the main spool is in the reverse position.

In certain embodiments, the main spool has a second inner wall, also preferably cylindrical, which forms a second inner cavity which extends axially from the mid-section of the main spool to the second end of the main spool. In such second inner cavity is a second constant-flow means which is responsive to inlet and load pressures to maintain constant flow through the forward port when the main spool is in a constant-flow forward position. In such embodiments, there are constant flow rates (not necessarily equal) in both directions of flow.

The main spool also has a plurality of spool voids and orifices, including or in addition to the inner cavity and pressure- and load-responsive means therein, which form, with the cylindrical wall of the valve body, flow channels between the ports. Such flow channels include at least one forward channel, a reverse channel, and a neutral channel.

Each forward channel connects the pressure, forward, reverse and tank ports in sequence through the motor when the main spool is in the forward rotational position or in one of more than one forward positions. The neutral channel directly connects the pressure and tank ports when the main spool is in the neutral rotational position. And, the reverse channel connects the pressure, reverse, forward and tank ports in sequence through the motor when the main spool is in the reverse rotational position.

The pressure- and load-responsive means to achieve a constant flow rate in the reverse direction preferably includes a hollow inner spool which is axially movable in the inner cavity between first and second positions. The inner spool has an endwall which is toward the mid-section of the main spool. The endwall has a fixed inflow means which allows passage of hydraulic fluid into the inner spool from a portion of the inner cavity beyond the endwall. The inner spool also has a lateral outflow means axially spaced from the endwall, and a sealing wall therebetween slidably engaging the inner wall.

The pressure- and load-responsive means also includes means biasing the inner spool to its first position, such as a spring, with orifices in the main spool which are positioned with respect to the sealing wall and lateral outflow means to achieve the desired constant flow.

A discharge orifice in the main spool, which is aligned with the reverse port when the main spool is in the reverse position, is axially located such that the lateral outflow means extends over it when the first inner spool is in its first position and the sealing wall extends increasingly over it as the first inner spool approaches its second position, movement which occurs as the pressure of the fluid beyond the endwall increases with respect to the pressure inside the inner spool. In this way increased relative fluid pressure restricts the effective size of the first discharge orifice.

At the same time as the discharge orifice is increasingly blocked by the sealing wall of the inner spool, means is provided for fluid bypass of the first inner spool as relative fluid pressure rises above a certain level. Such bypass means preferably includes a bypass orifice in the main spool which is occluded by the sealing wall of the inner spool when the inner spool is in its first position but increasingly exposed for bypass flow as the first inner spool approaches its second position.

More specifically, the sealing wall has first and second axial ends which are adjacent to the bypass orifice and first discharge orifice, respectively, the second axial end terminating at the lateral outflow means of the inner spool. As the lateral outflow means and sealing wall second axial end move across the discharge orifice, the sealing wall first axial end moves across the bypass orifice, allowing flow from the inner cavity to outside the main spool. A longitudinal bypass slot preferably extends along the main spool from the bypass orifice to a position of alignment with the valve body tank port when the main spool is in the reverse position, allowing the bypassing fluid to return to tank.

The inner wall (of the main spool) and the sealing wall (of the inner spool) are preferably cylindrical and in surface-to-surface contact, while the the lateral outflow means of the first inner spool preferably includes a recessed lateral wall area, adjacent to the sealing wall, which forms passage means.

The biasing means is preferably an axially-aligned coil spring having one end anchored at the first end of the main spool and the other end exerting force on the inner spool. An axially-adjustable plug is preferably at the first end of the main spool, allowing the degree of spring pressure on the inner spool to be readily adjusted to change the rate of constant flow through the reverse port.

In those embodiments having a second inner cavity and second pressure- and load-responsive means, as mentioned above, preferred structures include a second inner spool, main spool orifices, biasing means, and related parts similar in principle to those just described. There appears to be no need to repeat these descriptions, except to note that such second inner cavity extends axially from the main spool mid-section to the second end of the main spool and the biasing means is anchored at the second end of the main spool.

Such second pressure- and load-responsive means is for the purpose of maintaining constant flow through the forward port when the main spool is in a constant-flow forward position. The inner cavities are preferably both aligned on the main axis of the valve.

The reverse channel preferably includes a reverse-flow inlet in the main spool mid-section which extends to the inner cavity and, when the main spool is in reverse position, is located at the pressure port. The reverse channel also preferably includes a reverse-flow return recess in the main spool which is located and dimensioned to span the forward and tank ports when the main spool is in such reverse position.

One of the forward fluid-flow channels may include an input recess in the main spool located and dimensioned to span the pressure and forward ports when the main spool is in a corresponding forward position, and a forward-flow return recess in the main spool located and dimensioned to span the reverse and tank ports when the main spool is in such position. Such forward channels are useful for variable forward flow rather than constant flow.

The aforementioned longitudinal bypass slot associated with the reverse flow control is preferably part of the input recess. The input recess preferably forms a part of the reverse-flow return recess of the preferred reverse channel. Such overlapping provides apparent advantages, including fabrication advantages.

A preferred constant-flow forward channel includes a constant-forward-flow inlet in the mid-section of the main spool which extends to the second inner cavity and, when the main spool is in a constant-flow forward position, is located at the pressure port. Such forward channel also preferably includes a constant-forward-flow return recess in the main spool located and dimensioned to span the reverse and tank ports when the main spool is in the constant-flow forward position. Such return recess is preferably also the longitudinal bypass slot, again providing apparent advantages.

Certain preferred embodiments have both variable forward flow and constant forward flow, depending on the rotational position of the main spool. Such embodiments are four-way, four-position directional control valves.

In such preferred directional control valves, the reverse position of the main spool is preferably about 180 degrees from the variable-flow forward position and about 90 degrees from the neutral position. The constant-flow forward position is preferably between the variable-flow forward position and the neutral position, most preferably about 30 degrees from the neutral position.

Such positions, or whatever positions there are in various embodiments of this invention, may be defined by detent arrangements to facilitate positioning of the main spool by means of the control handle.

DETAILED DESCRIPTION OF PREFERRED EMBODIMENTS

Figures 1, 2:
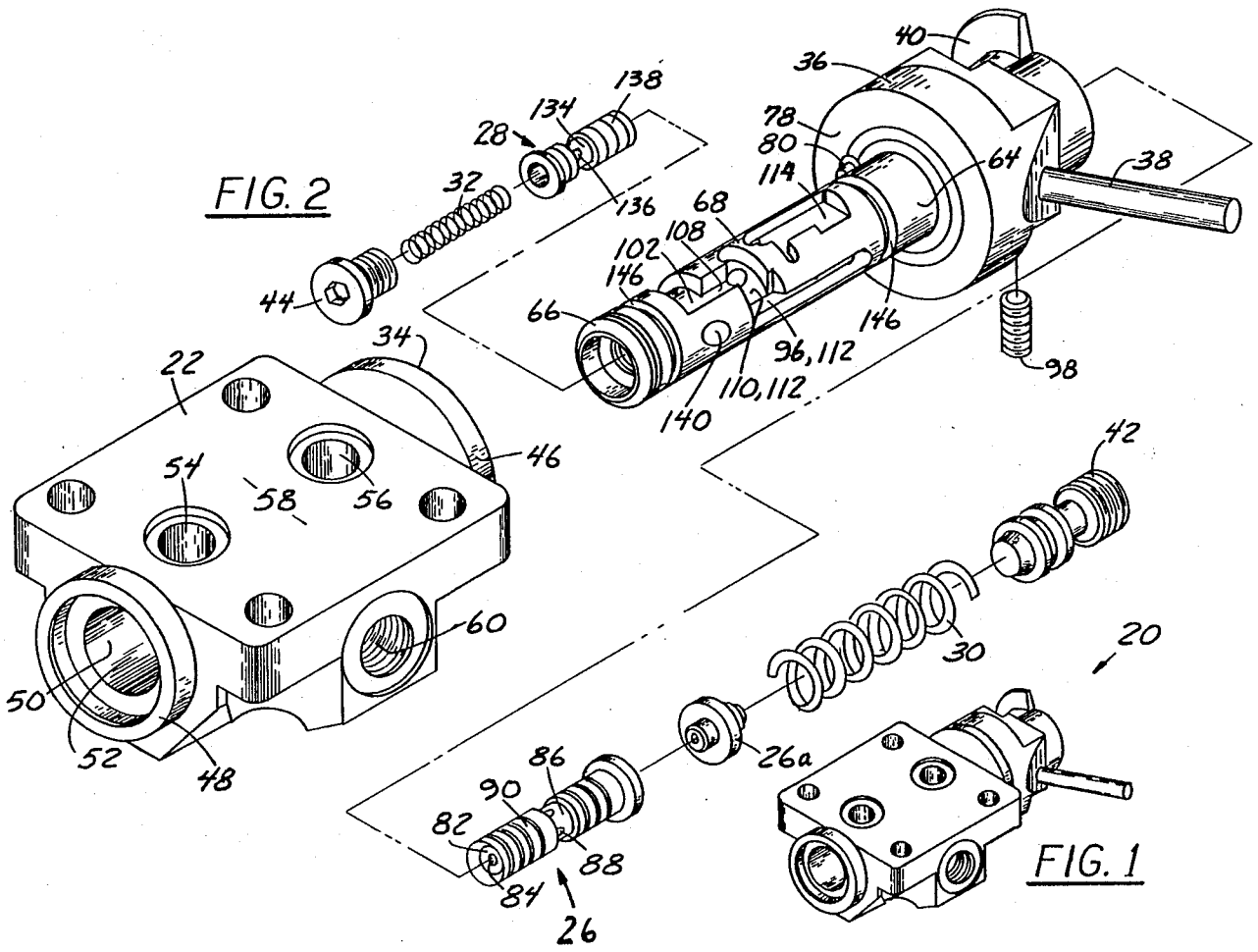
FIG. 1 is a perspective view of a preferred rotary-action directional flow control valve which is a preferred embodiment of this invention.
FIG. 2 is an enlarged exploded perspective view.

The figures illustrate a preferred rotary-action directional flow control valve 20. Control valve 20 is a four-way, four-position valve, which is adjustable to a reverse position, a neutral position, a variable-flow forward position and a constant-flow forward position. The reverse flow is always at a constant rate, which may readily be adjusted as desired.

Control valve 20 includes, as its principal parts, a valve body 22, a main spool 24, first and second inner spools 26 and 28, first and second coil springs 30 and 32, a valve body end face 34, a main spool end structure 36, a handle 38, a position stop knob 40, and first and second end plugs 42 and 44.

Valve body 22 has first and second ends 46 and 48, with valve body end face 34 forming first end 46. Valve body 22 has a cylindrical wall 50 forming a cylindrical main cavity 52 which contains main spool 24. Valve body 22 and its cylindrical wall 50 define forward and reverse ports 54 and 56 and have a middle portion 58 which is between ports 54 and 56. Middle portion 58 defines pressure and tank ports 60 and 62 which are at a common axial position but spaced 180 degrees apart on opposite sides of main cavity 52.

Figure 12:
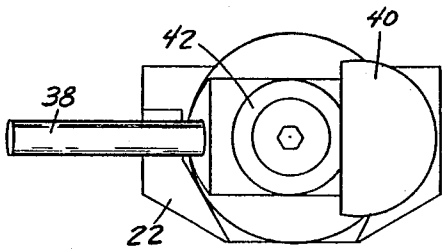
FIG. 12 is a right side elevation of FIG. 10.
Figure 11:
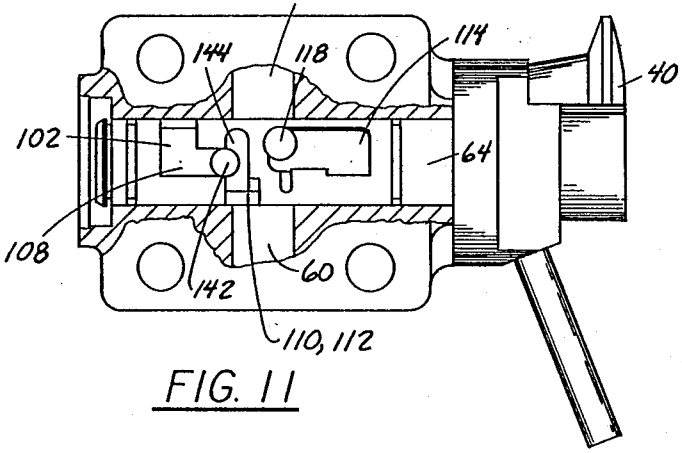
FIG. 11 is a partially cutaway top plan view of FIG. 10.

Main spool 24 is cylindrical and rotatable in main cavity 52 to four rotational positions. These include a reverse position, illustrated by FIGS. 3–6, a neutral position, illustrated by FIGS. 7–9, a constant-flow forward position, illustrated by FIGS. 13–16, and a variable-flow forward position, illustrated by FIGS. 10–12. The reverse position is 180 degrees from the variable-flow forward position and 90 degrees from the neutral position. The constant-flow forward position is between the variable-flow forward position and the neutral position, at 30 degrees from the neutral position.

Main spool 24 has first and second ends 64 and 66 corresponding approximately in position with first and second ends 46 and 48 of valve body 22. Main spool first and second ends 64 and 66 are well beyond reverse port 56 and forward port 54, respectively. Main spool 24 has a mid-section 68 which is adjacent to middle portion 58 of valve body 22.

Main spool 24 has first and second inner walls 70 and 72 which form first and second inner cavities 74 and 76, respectively. First inner cavity 74 extends axially from mid-section 68 all the way to main spool first end 64, while second inner cavity 76 extends axially from mid-section 68 all the way to main spool second end 66.

Main spool end structure 36 is rigidly attached to main spool first end 64 and has an inward face 78 in contact with valve body end face 34. Handle 38 is attached to main spool end structure 36 and extends therefrom in a direction transverse to the axis of main spool 24. Valve body end face 34 has four recesses (not shown) positioned around the main axis to correspond to the aforementioned rotatable positions of main spool 24. Main spool end structure 36 has a detent 80, partially seen in FIG. 2, which is spring-biased to protrude from inward face 78 to selectively engage the recesses in end face 34 when main spool 24 is in the desired rotational position. Position stop knob 40 is attached to detent 80 and is used to withdraw detent 80 from a recess, against spring pressure, to allow rotational movement of main spool 24.

As seen throughout the drawings, main spool 24 has a plurality of spool voids and orifices which form, themselves or with cylindrical wall 50 of valve body 22, flow channels between ports 54, 56, 60 and 62. The channels which are formed include a reverse channel, a neutral channel, a variable-flow forward channel and a constant-flow forward channel.

Each of the forward channels connects pressure port 60, forward port 54, reverse port 56 and tank port 62 in sequence through the hydraulic motor when main spool 24 is in either of its two forward positions. Likewise, the reverse channel connects pressure port 60, reverse port 56, forward port 54 and tank port 62 in sequence through the hydraulic motor when main spool 24 is in the reverse position. The neutral channel connects pressure port 60 and tank port 62 directly through main spool 24. The reverse channel, which is a constant-flow channel, and the constant-flow forward channel each include portions which are within first and second inner cavities 74 and 76, respectively, and first and second inner spools 26 and 28, respectively.

First inner spool 26 is axially movable within first inner cavity 74 (see FIG. 6) between a first position remote from main spool first end 64 and a second position closer to main spool first end 64. First end plug 42 is in threaded engagement with main spool first end 64 and first coil spring 30 extends in compression from first end plug 42 to first inner spool 26 through a spring end **26*a* engaged therewith (see FIG. 2). Thus, spring 30 serves to bias first inner spool 26 to its first position. First inner cavity 74 is largely occupied by inner spool 26; however, a portion of first inner cavity 74 is beyond the end of first inner spool 26 in a direction therefrom toward mid-section 68**.

Figure 6:
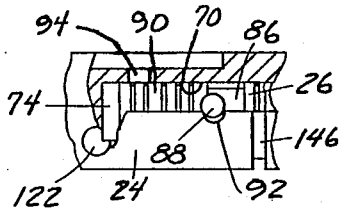
FIG. 6 is an enlarged fragmentary cutaway view of FIG. 4 with the main spool in section, taken along 6—6 as shown in FIG. 5.
Figure 5:
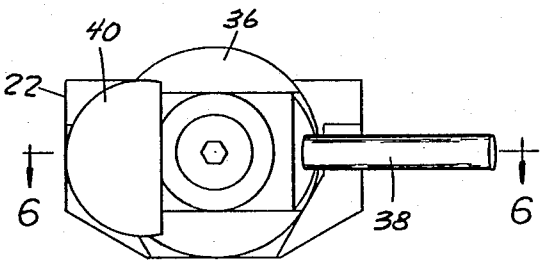
FIG. 5 is a right side elevation of FIG. 3.

As shown in FIGS. 2 and 6, first inner spool 26 includes an endwall 82 which has an axial orifice 84 therein defining a means for fixed inflow from the outside to the inside of first inner spool 26. First inner spool 26 also has an annular necked-in portion 86 which defines lateral orifices 88. Necked-in portion 86 and lateral orifices 88 together form a lateral outflow means which is axially spaced from endwall 82. First inner spool 26 also includes a sealing wall 90 which is between endwall 82 and necked-in portion 86 and is in surface-to-surface engagement with first inner wall 70 of main spool 24.

Figure 4:
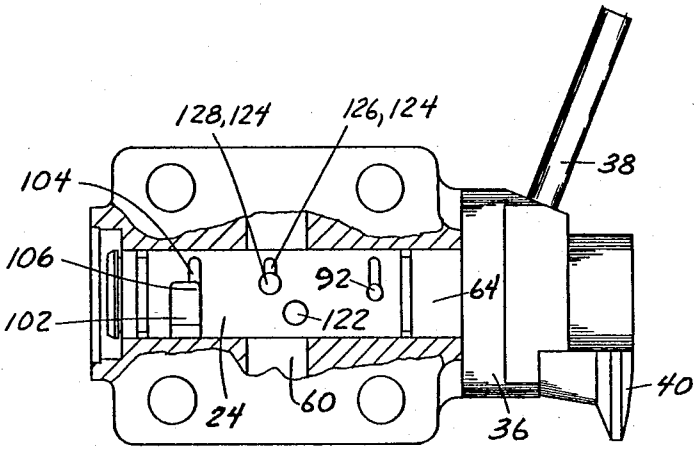
FIG. 4 is a partially cutaway top plan view of FIG. 3.
Figure 3:
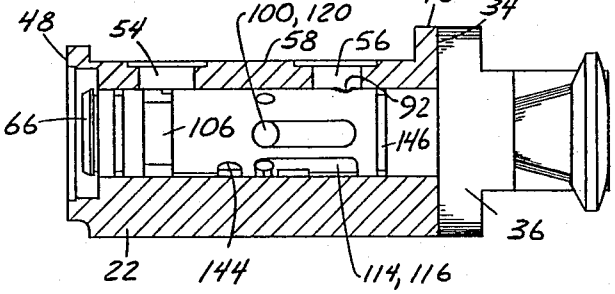
FIG. 3 is a side elevation with the valve body in section, showing the main spool rotated to the reverse position.

As shown in FIGS. 3–6, main spool 24 has a first discharge orifice 92 which is aligned with reverse port 56 when main spool 24 is in the reverse position. First discharge orifice 92 is axially located such that necked-in portion 86 and lateral orifices 88 extend over it when first inner spool 26 is in its first position, and such that sealing wall 90 extends increasingly over it to increasingly block it as first inner spool 26 approaches its second position. In FIGS. 3, 4 and 6, such movement of first inner spool 26 is to the right.

This movement occurs as the fluid pressure within first inner cavity 74 but outside first inner spool 26, that is, beyond endwall 82, increases relative to the combination of the fluid pressure inside first inner spool 26 and the biasing pressure of first coil spring 30. Such relative increased pressure, of course, tends to increase the fluid flow through orifices 84, but also, because of increasing blockage of orifice 92 by sealing wall 90, tends to stunt fluid flow through discharge orifice 92.

As this occurs, fluid bypasses first inner spool 26, moving instead toward and through tank port 62, as now described. Main spool 24 has a first bypass orifice 94 (see FIG. 6) which is completely occluded by sealing wall 90 when first inner spool 26 is in its first position. However, during movement of first inner spool 26 from its first position to its second position, first bypass orifice 94 is increasingly exposed, allowing fluid to flow from first inner cavity 74 rather than pass through orifice 84. Main spool 24 also includes a longitudinal bypass slot 96 which extends along main spool 24 in an axially parallel direction from first bypass orifice 94 to a position of alignment with tank port 62 when main spool 24 is in the reverse position.

This apparatus serves to keep the outflow through reverse port 56 at a substantially constant level when main spool 24 is in the full reverse position illustrated in FIGS. 3–6. Such constant level is determined by the setting of first end plug 42 in main spool first end 64 (see FIG. 2). The greater the compression of first coil spring 30, the greater the rate of constant reverse flow will be, and vice versa. Once a desired reverse flow rate is set, such setting may be locked in place by a set screw 98 which extends laterally through main spool end structure 36 to engage the side of first end plug 42. Set screw 98 is preferably a Nyloc screw which is adjustable by means of an Allen wrench.

The reverse channel, a portion of which extends through first inner cavity 74 and first inner spool 26 as already described, also includes a reverse-flow inlet 100 which is in main spool mid-section 68 and extends to first inner cavity 74. When main spool 24 is in the reverse position (see FIGS. 3–6), reverse flow inlet 100 is located at pressure port 60. Fluid from pressure port 60 passes through reverse-flow inlet 100 into that portion of first inner cavity 74 which is outside first inner spool 26, and flow from that point is as already described.

After the fluid passes through reverse port 56 and through the hydraulic motor, it returns to control valve 20 through forward port 54. The reverse channel further includes a reverse-flow return recess 102 in main spool 24 (see FIG. 4, and also FIGS. 2, 7, 11 and 14) located and dimensioned to span (that is, have fluid communication with) forward port 54 and tank port 62 when main spool 24 is in the reverse position. Reverse-flow return recess 102 includes contiguous small and large annular grooves 104 and 106, which extend in series around a good portion of main spool 24, a longitudinal recess 108 which extends along main spool 24 toward mid-section 68, a wide annular groove 110 which extends from longitudinal recess 108 further around main spool 24, and longitudinal bypass slot 96, already described.

The variable-flow forward channel, effective when main spool 24 is in its variable-flow forward position (see FIGS. 10–12), includes an input recess 112 in main spool 24, which is dimensioned to span pressure port 60 and forward port 54. Input recess 112 includes the aforementioned longitudinal bypass slot 96, wide annular groove 110, and longitudinal recess 108, which together also form a portion of reverse flow return recess 102. See FIGS. 10 and 11, and also FIGS. 2, 8, 14 and 18. After fluid passes through input recess 112 it passes through forward port 54 and through the hydraulic motor, returning to control valve 20 through reverse port 56.

The variable-flow forward channel also includes a forward-flow return recess 114 in main spool 24. See FIG. 11, and also 2, 3 and 14. Return recess 114 is located and dimensioned to span reverse port 56 and tank port 62 when main spool 24 is in the variable-flow forward position. The variable-flow forward channel also includes a hole 118 intersecting recess 114 (see FIG. 11) and an orifice 120 intersecting hole 118 (see FIG. 3). Orifice 120 is aligned with tank port 62 when main spool 24 is in the variable-flow forward position.

Figure 9:
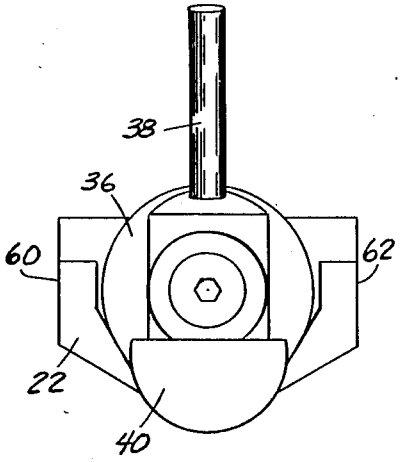
FIG. 9 is a right side elevation of FIG. 7.
Figure 8:
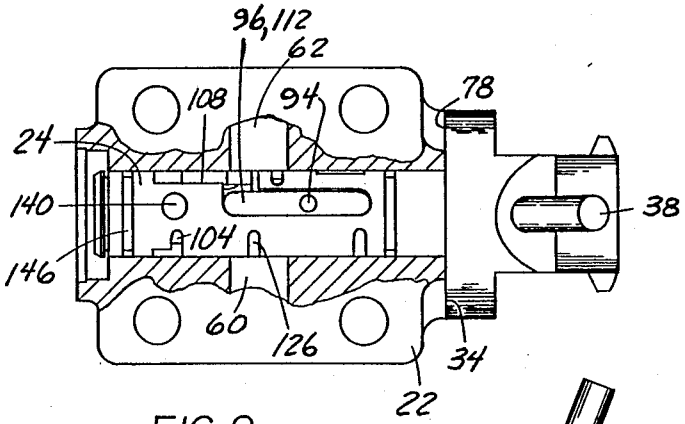
FIG. 8 is a partially cutaway top plan view of FIG. 7.
Figure 7:
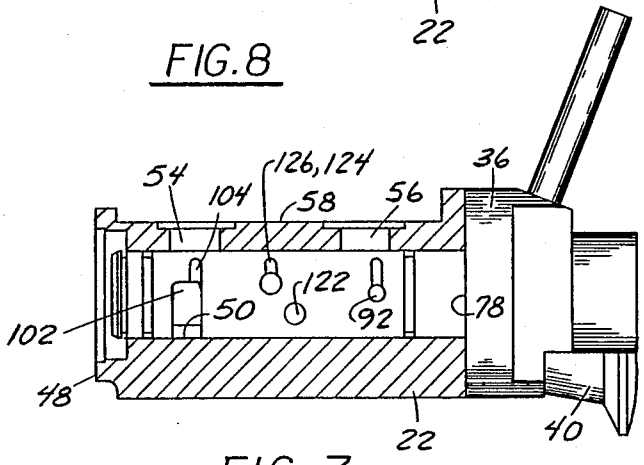
FIG. 7 is a side elevation with the valve body in section, showing the main spool in the neutral position.
Figure 10:
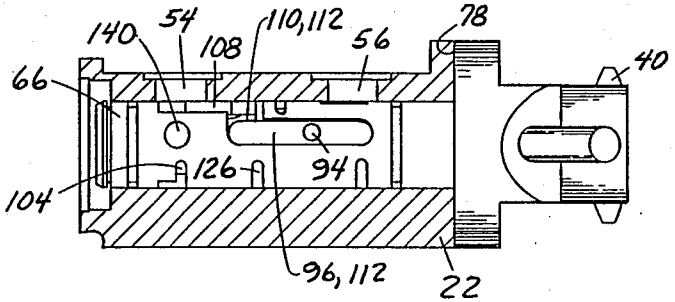
FIG. 10 is a side elevation with the valve body in section, showing the main spool in the variable-flow forward position.

The neutral channel, which directly connects pressure and tank ports 60 and 62 when main spool 24 is in the neutral position, includes a hole 122 (see FIG. 7 and FIG. 11) and hole 118, previously described. Holes 118 and 122 are in alignment and together allow passage of hydraulic fluid straight through main spool 24 from pressure port 60 to tank port 62. The neutral position is shown in FIGS. 7–9.

The constant-flow forward channel includes a constant-forward-flow inlet 124 (see FIGS. 13, 4 and 7) in main spool mid-section 68. Constant-forward-flow inlet 4 extends to second inner cavity 76 (see FIG. 16), which is the inner cavity of second inner spool 28. When main spool 24 is in its constant-forward-flow position, constant-forward-flow inlet 124 is at pressure port 60. A short annular groove 126 (FIG. 13) extends to inlet 124.

The constant-forward-flow channel has certain portions which are within second inner cavity 76. These will be described after describing the remaining portion of the constant-forward-flow channel.

The constant-forward-flow channel includes a constant-forward-flow return recess which is longitudinal bypass slot 96, previously described. Bypass slot 96 is located to span reverse port 56 and tank port 62 when main spool 24 is in its constant-flow forward position.

Input recess 112 and constant-forward-flow inlet 124 are rotationally offset with respect to each other, and variable-forward-flow return recess 114 and constant-forward-flow recess (bypass slot 96) are rotationally offset with respect to each other to a similar extent.

Second inner spool 28 in second inner cavity 76 functions in the same manner as first inner spool 26, but serves to provide a constant forward flow when main spool 24 is in the constant-flow forward position.

Second inner spool 28 is axially movable within second inner cavity 76 between a first position remote from main spool second end 66 and a second position closer to main spool second end 66. Second end plug 44 is in threaded engagement with main spool second end 66 and second coil spring 32 extends in compression from second end plug 44 to second inner spool 28. Thus, second coil spring 32 serves to bias second inner spool 28 to its first position. Second inner cavity 76 is largely occupied by second inner spool 28; however, a portion of second inner cavity 76 is beyond the end of second inner spool 26 in a direction therefrom toward mid-section 68.

Second inner spool 28 includes an endwall 130 which has an axial orifice 132 therein defining a means for fixed inflow from the outside to the inside of second inner spool 28. See FIG. 16. Second inner spool 28 also has an annular necked-in portion 134 which defines lateral orifices 136. See FIGS. 2 and 16. Necked-in portion 134 and lateral orifices 136 together form a lateral outflow means which is axially spaced from endwall 130. Second inner spool 28 also includes a sealing wall 138 which is between endwall 130 and necked-in portion 134 and is in surface-to-surface engagement with second inner wall 72 of main spool 24.

Figure 16:
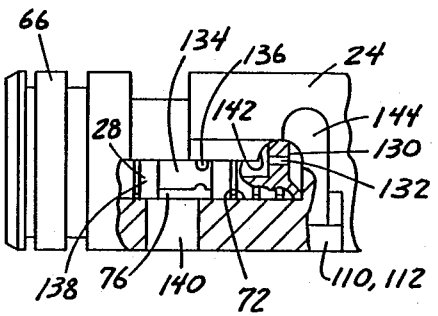
FIG. 16 is an enlarged fragmentary cutaway view of FIG. 14 with the main spool in section, taken along 16—16 as shown in FIG. 15.
Figure 15:
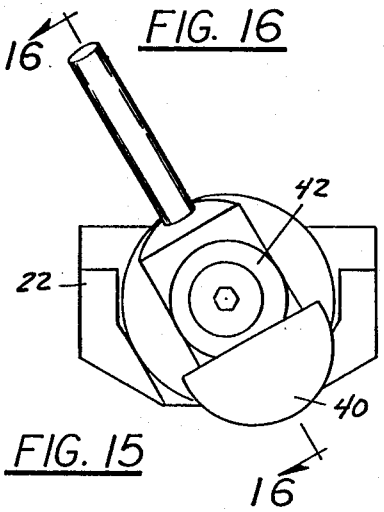
FIG. 15 is a right side elevation of FIG. 13.
Figure 14:
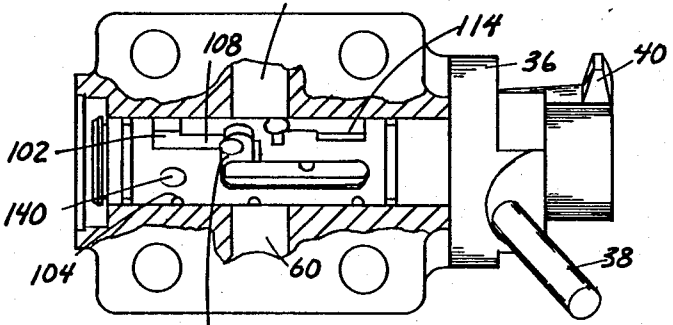
FIG. 14 is a partially cutaway top plan view of FIG. 13.
Figure 13:
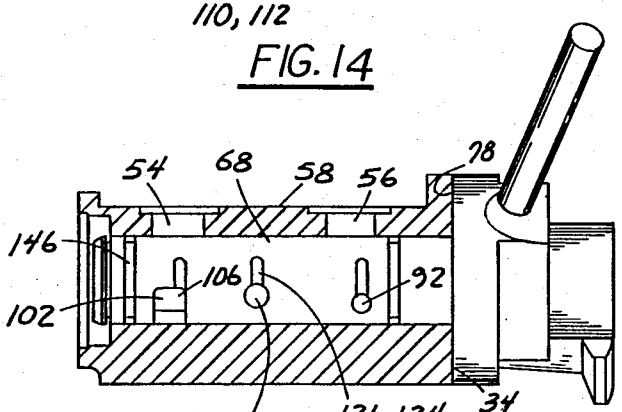
FIG. 13 is a side elevation with the valve body in section, showing the main spool in the constant-flow forward position.

As shown in FIGS. 14 and 16, main spool 24 has a second discharge orifice 140 (also seen in FIG. 8) which is aligned with forward port 54 when main spool 24 is in the constant-flow forward position. Second discharge orifice 140 is axially located such that necked-in portion 134 and lateral orifices 136 extend over it when second inner spool 28 is in its first position, and such that sealing wall 138 extends increasingly over it as second inner spool 28 approaches its second position. In FIGS. 13, 14 and 16, such movement of second inner spool 28 is to the left.

This movement occurs as the fluid pressure within second inner cavity 76 but outside second inner spool 28, that is, beyond endwall 130, increases relative to the combination of the fluid pressure inside second inner spool 28 and the biasing pressure of second coil spring 32. Such relative increased pressure, of course, tends to increase the fluid flow through orifices 132, but also tends to stunt fluid flow through second discharge orifice 140 by virtue of the movement of second inner spool 28.

As this occurs, fluid bypasses second inner spool 28, moving instead toward and through tank port 62, as now described. Main spool 24 has a second bypass orifice 142 (see FIG. 16) which is completely occluded by sealing wall 138 when second inner spool 28 is in its first position. However, during movement of second inner spool 28 from its first position to its second position, second bypass orifice 142 is increasingly exposed, allowing fluid to flow from second inner cavity 76 rather than pass through orifice 132. Main spool 24 also includes a short annular bypass slot 144 (see FIGS. 16, 3 and 11) which intersects second bypass orifice 142 and extends around main spool 24 to a position adjacent to tank port 62 when main spool 24 is in the constant-flow forward position.

This apparatus serves to keep the outflow through forward port 54 at a substantially constant level. Such constant level is determined by the setting of second end plug 44 in main spool second end 66. The greater the compression of second coil spring 32, the greater the rate of constant reverse flow will be, and vice versa. In the embodiment illustrated, fine adjustment of the constant forward flow rate is not contemplated.

Adjustment of constant flow rates in the forward and reverse directions, particularly major adjustments, may be made by selection of sizes of orifices 84 and 132 in endwalls 82 and 130. This usually involves replacing inner spools as necessary. Adjustment by means of end plugs 42 and 44 is usually relatively fine adjustment.

Main spool 24 has 360-degree annular grooves 146 extending therearound. Grooves 146 are used to hold O-rings used for sealing main cavity 52.

In some embodiments of this invention, the forward and reverse ports may be shut off completely when the main spool is rotated to a neutral position. In some embodiments, it is possible to shut off the pressure port by a rotational position of the main spool.

The control valve of this invention may be fabricated using conventional materials, preferably steel and aluminum, as will be apparent to those skilled in the art. Standard seals and the like may also be used.

In certain embodiments, it is possible that portions of what would more typically be a separate valve body may be incorporated in the hydraulic motor itself. In such embodiments, the essential elements of the invention would be found in the composite construction.

While the principles of this invention have been described in connection with specific embodiments, it should be understood clearly that these descriptions are made only by way of example and are not intended to limit the scope of the invention.

What is claimed:

1. A rotary-action directional flow control valve for a hydraulic motor, comprising:

a valve body including a cylindrical wall which forms a main cavity and has axially-spaced forward and reverse ports and a middle portion therebetween having pressure and tank ports;

a main spool in the main cavity rotatable to at least one forward, a reverse and a neutral position and having a mid-section adjacent to the middle portion of the body, first and second ends beyond the reverse and forward ports, respectively, and an inner wall forming an inner cavity extending axially from the mid-section to the first end;

a plurality of spool voids and orifices forming, with the body, flow channels between the ports, including:

at least one forward channel connecting the pressure, forward, reverse and tank ports in sequence through the motor in said at least one forward position, a neutral channel directly connecting the pressure and tank ports in the neutral position, and a reverse channel connecting the pressure, reverse, forward and tank ports in sequence through the motor in the reverse position; and means in the inner cavity responsive to inlet and load pressures to maintain substantially constant flow through the reverse port when the main spool is in the reverse position.

2. The directional flow control valve of claim 1 further comprising:

the main pool having a second inner wall forming a second inner cavity extending axially from the mid-section to the second end of the main spool; and second constant-flow means in the second inner cavity responsive to inlet and load pressures to maintain constant flow through the forward port when the main spool is in a constant-flow forward position.

3. The directional flow control valve of claim 1 wherein the constant-flow means comprises:

a first hollow inner spool axially movable in the inner cavity between first and second positions and having an endwall with a fixed inflow means, a lateral outflow means axially spaced from the endwall, and a sealing wall therebetween slidably engaging the inner wall;

means biasing the first inner spool to its first position; and a first discharge orifice in the main spool aligned with the reverse port when the main spool is in the reverse position and axially located such that the lateral outflow means extends over it when the first inner spool is its first position and the sealing wall extends increasingly over it as the first inner spool approaches its second position, whereby increased fluid pressure restricts the effective size of the first discharge orifice.

4. The directional flow control valve of claim 3 having means for fluid bypass of the first inner spool when fluid pressure rises above a certain level, the bypass means comprising:

a bypass orifice in the main spool occluded by the sealing wall of the first inner spool when the first inner spool is in its first position but increasingly exposed for bypass flow as the first inner spool approaches its second position; and a longitudinal bypass slot extending along the main spool from the bypass orifice to a position of alignment with the tank port when the main spool is in the reverse position, whereby fluid bypassing the first inner spool returns to tank.

5. The directional flow control valve of claim 4 wherein:

the inner wall of the main spool is cylindrical;

the sealing wall of the first inner spool is cylindrical; and the outflow means of the first inner spool comprises a recessed lateral wall area adjacent to the sealing wall and forming passage means.

6. The directional flow control valve of claim 5 wherein the biasing means is an axially-aligned coil spring having one end anchored at the first end of the main spool and the other end exerting force on the first inner spool.

7. The directional flow control valve of claim 6 further including an axially-adjustable plug at the first end of the main spool, whereby the degree of spring pressure on the first inner spool can readily be adjusted to change the rate of constant flow through the reverse port.

8. The directional flow control valve of claim 4 further comprising:

the main spool having a second inner wall forming a second inner cavity extending axially from the mid-section to the second end of the main spool; and second constant-flow means in the second inner cavity responsive to inlet and load pressures to maintain constant flow through the forward port when the main spool is in a constant-flow forward position.

9. The directional flow control valve of claim 8 wherein the second constant-flow means comprises:

a second hollow inner spool axially movable in the inner cavity between first and second positions and having an endwall with a fixed inflow means, a lateral outflow means axially spaced from the endwall, and a sealing wall therebetween slidably engaging the second inner wall;

means biasing the second inner spool to its first position; and a second discharge orifice in the main spool aligned with the forward port when the main spool is in the constant-flow forward position and axially located such that the second inner spool lateral outflow means extends over it when the second inner spool is its first position and the second inner spool sealing wall extends increasingly over it as the second inner spool approaches its second position, whereby increased fluid pressure restricts the effective size of the second discharge orifice.

10. The directional flow control valve of claim 9 having means for fluid bypass of the second inner spool when fluid pressure rises above a certain level, said second bypass means comprising:

a second bypass orifice in the main spool occluded by the sealing wall of the second inner spool when the second inner spool is in its first position but increasingly exposed for bypass flow as the second inner spool approaches its second position, said second bypass orifice communicating with the tank port when the main spool is in the constant-flow forward position, whereby fluid bypassing the second inner spool returns to the tank.

11. The directional flow control valve of claim 10 wherein:

the inner walls of the main spool are cylindrical;

the sealing walls of the first and second inner spools are cylindrical; and each of the outflow means of the first and second inner spools comprises a recessed lateral wall area which is adjacent to the sealing wall of such inner spool and forms passage means.

12. The directional flow control valve of claim 11 wherein the biasing means for the first and second inner spools are axially-aligned coil springs, the biasing means for the first inner spool having one end anchored at the first end of the main spool and the other end exerting force on the first inner spool, and the biasing means for the second inner spool having one end anchored at the second end of the main spool and the other end exerting force on the second inner spool.

13. The directional flow control valve of claim 4 wherein one forward channel comprises:

an input recess in the main spool located and dimensioned to span the pressure and forward ports when the main spool is in such forward position; and a forward-flow return recess in the main spool located and dimensioned to span the reverse and tank ports when the main spool is in one of the forward positions.

14. The directional flow control valve of claim 13 wherein the longitudinal bypass slot is part of the input recess.

15. The directional flow control valve of claim 4 wherein the reverse channel comprises:

a reverse-flow inlet in the mid-section of the main spool which extends to the inner cavity and, when the main spool is in the reverse position, is located at the pressure port; and a reverse-flow return recess in the main spool located and dimensioned to span the forward and tank ports when the main spool is in the reverse position.

16. The directional flow control valve of claim 15 wherein one forward channel comprises:

an input recess in the main spool located and dimensioned to span the pressure and forward ports when the main spool is in such forward position, said input recess forming a part of the reverse-flow return recess; and a forward-flow return recess in the main spool located and dimensioned to span the reverse and tank ports when the main spool is in one of the forward positions.

17. The directional flow control valve of claim 16 wherein the longitudinal bypass slot is part of the input recess.

18. The directional flow control valve of claim 4 including a constant-flow forward channel comprising:

a constant-forward-flow inlet in the mid-section of the main spool which extends to the second inner cavity and, when the main spool is in a constant-flow forward position, is located at the pressure port; and a constant-forward-flow return recess in the main spool located and dimensioned to span the reverse and tank ports when the main spool is in the constant-flow forward position.

19. The directional flow control valve of claim 18 wherein the constant-forward-flow return recess is the longitudinal bypass slot.

20. The directional flow control valve of claim 18 including a variable-flow forward channel comprising:

an input recess in the main spool located and dimensioned to span the pressure and forward ports when the main spool is in a variable-flow forward position, the input recess being rotationally offset from the constant-forward-flow inlet; and a variable-forward-flow return recess in the main spool located and dimensioned to span the reverse and tank ports when the main spool is in the variable-flow forward position, the variable-forward-flow return recess being rotationally offset from the constant-forward-flow return recess, thereby providing a four-way, four-position directional control valve.

21. The directional flow control valve of claim 20 wherein the constant-forward-flow return recess is the longitudinal bypass slot.

22. The directional flow control valve of claim 21 wherein the reverse position of the main spool with respect to the valve body is about 180 degrees from the variable-flow forward position and about 90 degrees from the neutral position, and the constant-flow forward position is between the variable-flow forward position and the neutral position.

23. The directional flow control valve of claim 4 wherein a control handle for rotating the main spool is secured to the main spool at its first end.

24. A rotary-action directional flow control valve for a hydraulic motor, comprising:

a valve body including a cylindrical wall which forms a main cavity and has forward and reverse ports and pressure and tank ports;

a main spool in the main cavity rotatable to at least one forward, a reverse and a neutral position and having first and second ends and an inner wall forming an inner cavity extending axially from the mid-section to the first end;

a plurality of spool voids and orifices forming, with the body, flow channels between the ports, including:

at least one forward channel connecting the pressure, forward, reverse and tank ports in sequence through the motor in said at least one forward position, a neutral channel directly connecting the pressure and tank ports in the neutral position, and a reverse channel connecting the pressure, reverse, forward and tank ports in sequence through the motor in the reverse position; and means in the inner cavity responsive to inlet and load pressures to maintain substantially constant flow through the reverse port when the main spool is in the reverse position.

25. A rotary-action directional flow control valve for a hydraulic motor, comprising:

a valve body including a cylindrical wall which forms a main cavity and has axially-spaced forward and reverse ports and a middle portion therebetween having pressure and tank ports;

a main spool in the main cavity rotatable to at least one forward, a reverse and a neutral position and having a mid-section adjacent to the middle portion of the body, first and second ends beyond the reverse and forward ports, respectively, and an inner wall forming an inner cavity extending axially from the mid-section to the first end;

a plurality of spool voids and orifices forming, with the body, flow channels between the ports, including at least one forward channel connecting the pressure, forward, reverse and tank ports in sequence through the motor in said at least one forward position, and a reverse channel connecting the pressure, reverse, forward and tank ports in sequence through the motor in the reverse position; and means in the inner cavity responsive to inlet and load pressures to maintain substantially constant flow through the reverse port when the main spool is in the reverse position.

* * * * *

UNITED STATES PATENT AND TRADEMARK OFFICE

CERTIFICATE OF CORRECTION

PATENT NO. : 4,836,249

DATED : June 6, 1989

INVENTOR(S) : Roland R. LaPointe

It is certified that error appears in the above-identified patent and that said Letters Patent is hereby corrected as shown below:

On the title page change the Inventor's name from "Ronald" to --Roland--.

On the title page, change the attorney, agent or firm from "Peter N. Ltd. Jansson" to --Law Firm of Peter N. Jansson, Ltd.--.

At Column 1, Line 35, after "needed", insert --.--.

At Column 9, Line 39, change "4" to --124--.

Signed and Sealed this

Sixth Day of February, 1990

*Attest:*

JEFFREY M. SAMUELS

*Attesting Officer*

*Acting Commissioner of Patents and Trademarks*